US011434666B2

(12) United States Patent
Lee

(10) Patent No.: US 11,434,666 B2
(45) Date of Patent: Sep. 6, 2022

(54) ANTI-THEFT DOOR LOCK ASSEMBLY

(71) Applicant: WELL LAUD MANUFACTURING CORP., Taichung (TW)

(72) Inventor: Ching-Yen Lee, Yunlin County (TW)

(73) Assignee: WELL LAUD MANUFACTURING CORP., Taichung (TW)

( * ) Notice: Subject to any disclaimer, the term of this patent is extended or adjusted under 35 U.S.C. 154(b) by 294 days.

(21) Appl. No.: 16/708,522

(22) Filed: Dec. 10, 2019

(65) Prior Publication Data

US 2021/0062552 A1 Mar. 4, 2021

(30) Foreign Application Priority Data

Aug. 26, 2019 (CN) ..... 201910791016.1

(51) Int. Cl.
*E05B 65/10* (2006.01)

(52) U.S. Cl.
CPC ..... *E05B 65/1006* (2013.01); *E05Y 2900/132* (2013.01)

(58) Field of Classification Search
CPC ..... Y10T 292/0849; Y10T 292/0859; Y10T 292/0908; Y10T 292/0909; Y10T 292/091; Y10T 292/564; Y10T 70/5159; E05B 65/1006; E05B 65/10; E05B 65/1013; E05B 65/1046; E05B 65/1053; E05B 65/1093; E05Y 2900/132; E05C 9/002; E05C 9/008; E05C 9/04; E05C 9/043; E05C 9/048; E05C 9/16; Y10S 292/65

See application file for complete search history.

(56) References Cited

U.S. PATENT DOCUMENTS 3,767,238 A * 10/1973 Zawadzki ..... E05B 65/1053 292/21
3,970,339 A * 7/1976 Haselton ..... E05B 65/1073 292/227
4,796,931 A * 1/1989 Heid ..... E05B 65/1053 292/337
4,961,330 A * 10/1990 Evans ..... E05B 47/0603 292/92
5,340,171 A * 8/1994 Slaybuagh ..... E05B 47/023 292/201
5,605,362 A * 2/1997 Surko, Jr. ..... E05B 65/1053 292/92
6,009,732 A * 1/2000 Haeck ..... E05B 65/1053 70/92

(Continued)

FOREIGN PATENT DOCUMENTS

EP 0481931 A1 * 4/1992 ..... E05B 65/1053
WO WO-2008043868 A1 * 4/2008 ..... E05B 63/0056

*Primary Examiner* — Kristina R Fulton
*Assistant Examiner* — Steven A Tullia
(74) *Attorney, Agent, or Firm* — WPAT, PC

(57) ABSTRACT

An anti-theft door lock assembly includes a main locking unit. The main locking unit has a main lock set, a lock tongue disposed inside the main lock set and having one end thereof to protrude out of the main lock set, a pushed member disposed inside the main lock set and connected with another end of the lock tongue, a connection link disposed inside the main lock set and connected with the pushed member, an action member disposed at one end of the main lock set, and a depression rocker arm furnished to the main lock set and connected with the connection link.

7 Claims, 8 Drawing Sheets

(56) References Cited

U.S. PATENT DOCUMENTS

| | | | | |
|---|---|---|---|---|
| 6,032,985 | A * | 3/2000 | Cutter | E05B 63/202 292/92 |
| 6,048,000 | A * | 4/2000 | Geringer | E05B 47/0002 292/166 |
| 2007/0246946 | A1* | 10/2007 | Arlinghaus | E05B 15/102 292/93 |
| 2008/0169655 | A1* | 7/2008 | Gomez Gonzalez | E05C 9/048 292/81 |
| 2009/0051172 | A1* | 2/2009 | Yu | E05C 9/1875 292/198 |
| 2009/0107189 | A1* | 4/2009 | Lin | E05B 65/106 70/91 |
| 2009/0194999 | A1* | 8/2009 | Shen | E05B 63/0056 292/219 |
| 2010/0007154 | A1* | 1/2010 | Schacht | E05B 65/1053 292/92 |
| 2010/0109352 | A1* | 5/2010 | Tien | E05B 65/1006 292/336.3 |
| 2013/0093195 | A1* | 4/2013 | Tien | E05B 65/1006 292/93 |
| 2014/0102155 | A1* | 4/2014 | Lin | E05C 9/048 70/92 |
| 2018/0119456 | A1* | 5/2018 | Blanchard | E05B 15/16 |
| 2018/0148955 | A1* | 5/2018 | Yalamati | E05C 21/00 |

* cited by examiner

ANTI-THEFT DOOR LOCK ASSEMBLY

CROSS REFERENCE TO RELATED APPLICATION

This application claims the benefits of China application Serial No. 201910791016.1, filed on Aug. 26, 2019, the disclosures of which are incorporated by references herein in its entirety.

TECHNICAL FIELD

The present disclosure relates in general to an anti-theft door lock assembly, and more particularly to a door lock structure that can be applied to a safety door or an emergency exit for preventing the door from being pried open.

BACKGROUND

Currently, the safety door, the emergency exit or the like is necessary for people inside a building to safely and rapidly escape while in facing a catastrophe such as a fire and an earthquake. On the other hand, another purpose of the safety door is to prevent unexpected persons from entering the buildings.

Nevertheless, the conventional safety door has anyway a key element yet but needed to be improved. This key element is the door lock of the safety door, which is quite easy to be pried open, and thus the building would be broken in. Since the conventional door lock is vulnerable to be pried open, thus some unexpected people would enter the buildings illegally, and from which possible property or person damage might be met. Hence, an improvement upon the conventional door lock is definitely urgent and welcome to the skill in the art.

SUMMARY

Accordingly, it is an object of this disclosure to provide an anti-theft door lock assembly that is not so easy to be pried open by any means. Thereupon, unexpected persons can be successfully rejected outside the building, and thus safety guards and private or public properties would be prevented from possible loss.

In this disclosure, an anti-theft door lock assembly includes a main locking unit. The main locking unit has a main lock set, a lock tongue disposed inside the main lock set and having one end thereof to protrude out of the main lock set, a pushed member disposed inside the main lock set and connected with another end of the lock tongue, a connection link disposed inside the main lock set and connected with the pushed member, an action member disposed at one end of the main lock set, and a depression rocker arm furnished to the main lock set and connected with the connection link.

In one embodiment of this disclosure, the anti-theft door lock assembly further includes at least one auxiliary lock set and at least one auxiliary locking unit. The at least one auxiliary lock set is disposed respectively to at least one side of the main lock set, and each of the at least one auxiliary lock set has an auxiliary rocker arm moving with the lock tongue. Each of the at least one auxiliary locking unit has an auxiliary lock-mounting frame, an auxiliary lock tongue, an auxiliary-lock pull member, an auxiliary-lock connection link and an auxiliary-lock extension linkage.

The auxiliary lock tongue is disposed in the auxiliary lock-mounting frame but protrudes a portion thereof out of the auxiliary lock-mounting frame. The auxiliary-lock pull member is disposed in the auxiliary lock-mounting frame and connected with the auxiliary lock tongue. The auxiliary-lock connection link is disposed in the auxiliary lock-mounting frame and connected with the auxiliary-lock pull member. One end of the auxiliary-lock extension linkage is connected with the auxiliary-lock connection link while another end of the auxiliary-lock extension linkage is connected with the auxiliary rocker arm.

In one embodiment of this disclosure, the anti-theft door lock assembly further includes a depressing unit and a push-down cover. The depressing unit has a depression-mounting frame and an extension linkage. The depression-mounting frame is furnished with a push-down rocker arm. One end of the extension linkage is connected with the push-down rocker arm while another end of the extension linkage is connected with the press-down rocker arm. The push-down cover is disposed above the push-down rocker arm.

In one embodiment of this disclosure, the anti-theft door lock assembly further includes a depressing unit having a depression bar, and the depression bar is moved with the depression rocker arm.

In one embodiment of this disclosure, the main lock set has a main mounting frame structure, each of two opposing sides of the main mounting frame structure has a main structural aperture, a lock-tongue installation pin penetrates through the main mounting frame structure, the lock tongue and a lock-tongue torsion spring so as to mount pivotally the lock tongue to the main mounting frame structure, the lock tongue has an accommodation space located at a bottom portion thereof and a guide hole communicated spatially with the accommodation space, a push member is disposed in the accommodation space but protruding one end thereof out of the accommodation space, a push rod penetrates through the guide hole, a push spring and the push member so as to mount pivotally the push member to the lock tongue, and the depression rocker arm has a pivotal pin extending out of the main mounting frame structure from the main structural aperture.

In one embodiment of this disclosure, the pushed member is located between the push member and the lock tongue, a pivotal pin penetrates through another end of the pushed member, a torsion spring and one end of the connection link so as to connect the pushed member and the connection link.

In one embodiment of this disclosure, the depression rocker arm is pivotally mounted to the main mounting frame structure via a pivotal pin, the pivotal pin penetrates through the action member, a rocker-arm torsion spring and the depression rocker arm, one end of the depression rocker arm serves as a depression end while another end of the depression rocker arm serves as a push end, and the push end contacts against the pivotal pin.

In one embodiment of this disclosure, a push-down pivotal pin penetrates through the depression-mounting frame, a push-down torsion spring and the push-down rocker arm, the extension linkage has a main extension bar, an auxiliary extension bar and two hook elements, one of the two hook elements is connected with the main extension bar, the auxiliary extension bar is connected with the main extension bar, another one of the two hook elements is connected with the auxiliary extension bar, the one of the two hook elements is hooked with the push-down rocker arm, and the another one of the two hook elements is hooked with the depression end of the depression rocker arm.

In one embodiment of this disclosure, the auxiliary-lock pull member and the auxiliary-lock connection link are connected via an auxiliary-lock pivotal pin, and the auxiliary-lock pivotal pin penetrates through one end of the auxiliary-lock connection link, an auxiliary-lock connection spring and another end of the auxiliary-lock pull member.

In one embodiment of this disclosure, one end of the auxiliary rocker arm serves as an auxiliary-lock push end, the auxiliary-lock extension linkage has a main auxiliary-lock extension bar, a second auxiliary-lock extension bar and two auxiliary-lock hook elements, one of the two auxiliary-lock hook elements is connected with the main auxiliary-lock extension bar, the second auxiliary-lock extension bar is connected with the main auxiliary-lock extension bar, another one of the two auxiliary-lock hook elements is connected with the second auxiliary-lock extension bar, the one of the two auxiliary-lock hook elements is hooked with the auxiliary-lock connection link, the another one of the two auxiliary-lock hook elements is hooked with the auxiliary-lock push end, and an auxiliary-lock cover is to cover the auxiliary-lock extension linkage.

As stated, the lock tongue provided by this disclosure is controlled by the pushed member to protrude or retrieve with respect to the main lock set, thus, when the safety door is in the locking state, the lock tongue restrained by the pushed member is unable to be retrieved back to the main lock set, even that the lock tongue is forced by any arbitrary foreign forcing. Thereupon, the safety door would not be easy to be pried open, and thus possible illegal invasion by unexpected persons via the safety door would be inhibited.

Further scope of applicability of the present application will become more apparent from the detailed description given hereinafter. However, it should be understood that the detailed description and specific examples, while indicating exemplary embodiments of the disclosure, are given by way of illustration only, since various changes and modifications within the spirit and scope of the disclosure will become apparent to those skilled in the art from this detailed description.

BRIEF DESCRIPTION OF THE DRAWINGS

The present disclosure will become more fully understood from the detailed description given herein below and the accompanying drawings which are given by way of illustration only, and thus are not limitative of the present disclosure and wherein.

DETAILED DESCRIPTION

Figure 1:
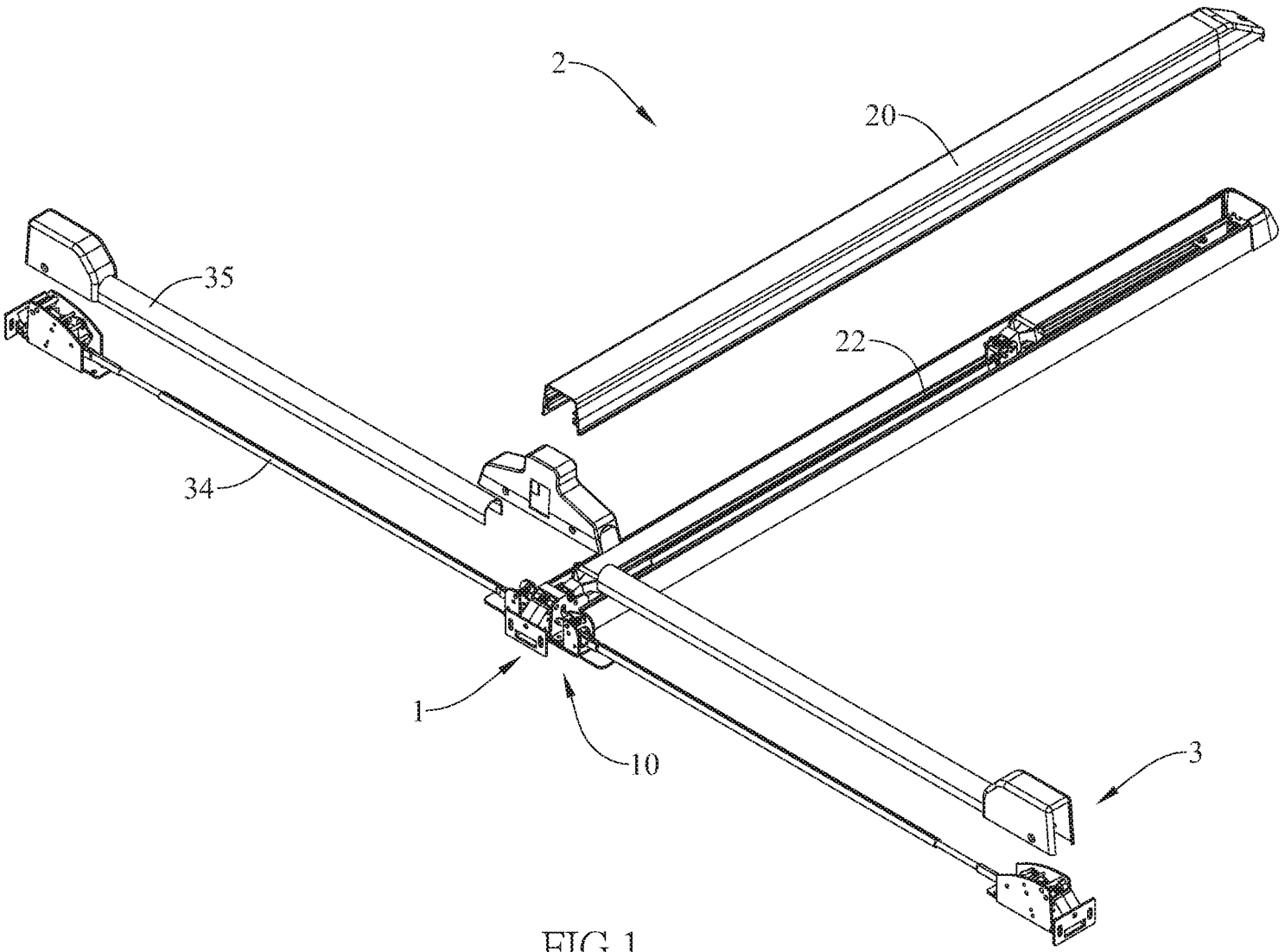
FIG. 1 is a schematic large exploded view of the preferred anti-theft door lock assembly in accordance with this disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Referring now to FIG. 1, the anti-theft door lock assembly of this disclosure includes a main locking unit 1, a depressing unit 2 and at least one auxiliary locking unit 3.

Referring to FIG. 2, FIG. 3, FIG. 5 and FIG. 6, the main locking unit 1 has a main lock set 10, a lock tongue 11, a push member 12, a pushed member 13, a connection link 14, a depression rocker arm 15 and at least one auxiliary lock set 16.

The main lock set 10 has a main mounting frame structure 100. Each of two opposing sides of the main mounting frame structure 100 has a main structural aperture 101. The lock tongue 11 is disposed inside the main mounting frame structure 100. A lock-tongue installation pin 110 is introduced to penetrate through the main mounting frame structure 100, the lock tongue 1 land a lock-tongue torsion spring 111, so that the lock tongue 11 can be pivotally disposed inside the main mounting frame structure 100. One end of the lock tongue 11 protrudes out of the main mounting frame structure 100. One end of the lock-tongue torsion spring 111 contacts against the lock tongue 11, while another end of the lock-tongue torsion spring 111 contacts against the lock-tongue installation pin 110. The lock tongue 11 has an accommodation space 112 located at a bottom thereof and a guide hole 113 communicative with the accommodation space 112.

The push member 12, disposed in the accommodation space 112, has one end thereof protruding out of the accommodation space 112. A push rod 120 is introduced to penetrate through the guide hole 113, a push spring (not shown in the figure) and the push member 12, so as to pivot the push member 12 elastically onto the lock tongue 11. One end of the push spring is pushed against the push member 12, while another end thereof is pushed against the push rod 120.

Figure 3:
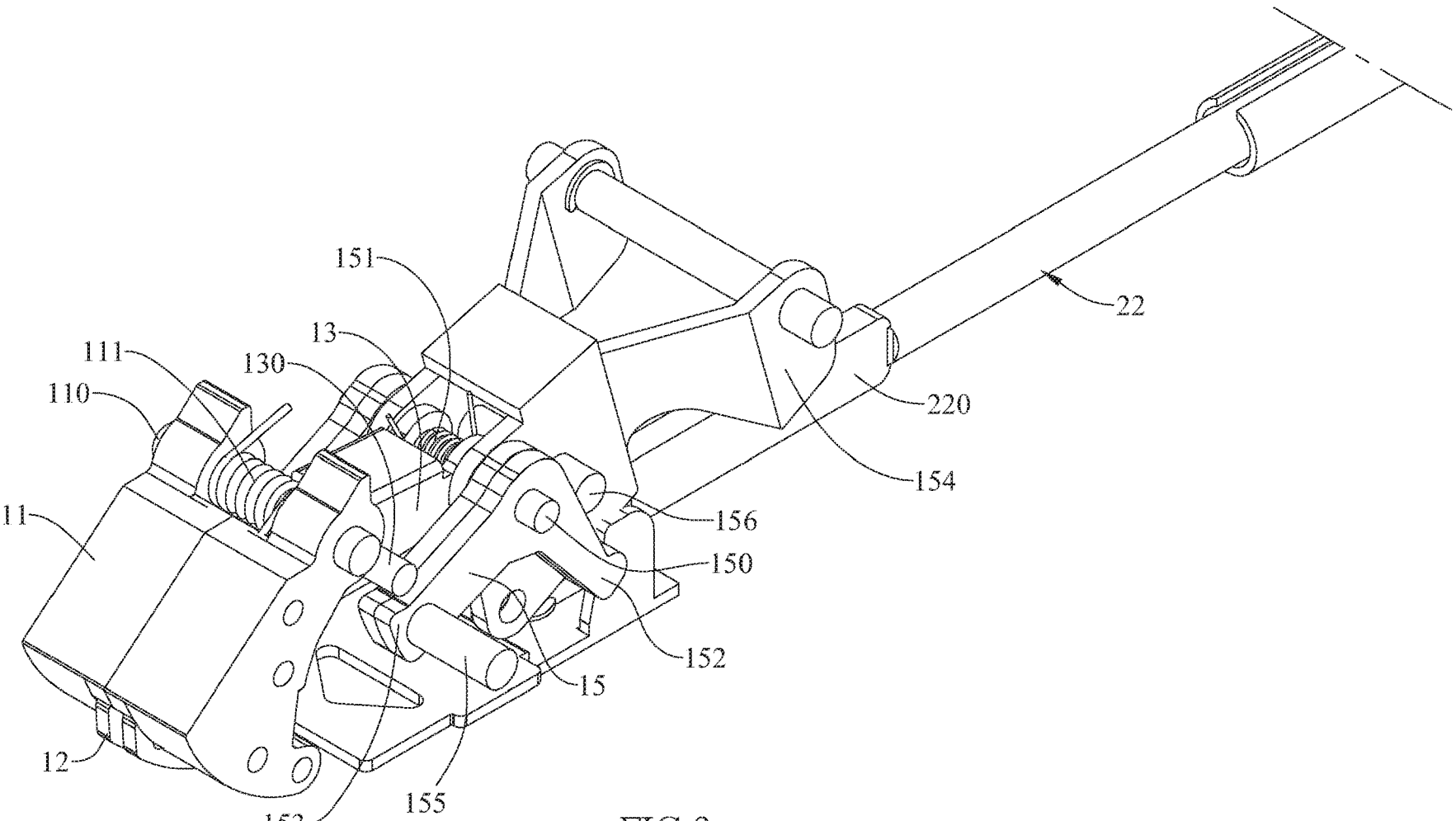
FIG. 3 is a schematic enlarged view of a portion of FIG. 2.
Figure 6:
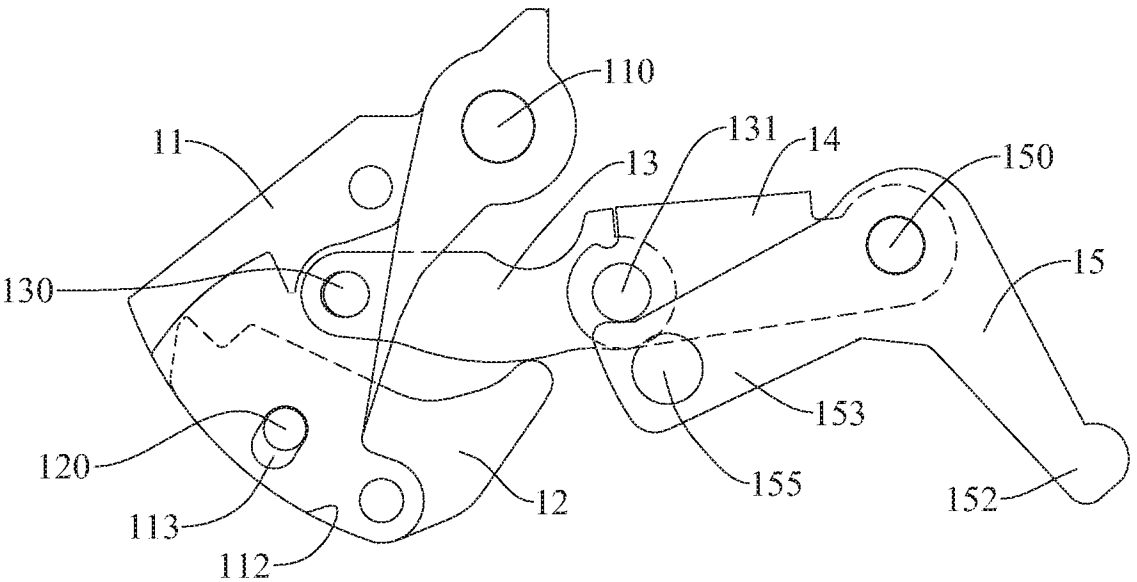
FIG. 6 is a schematic view of a portion of the anti-theft door lock assembly in a motionless state in accordance with this disclosure.
Figure 7:
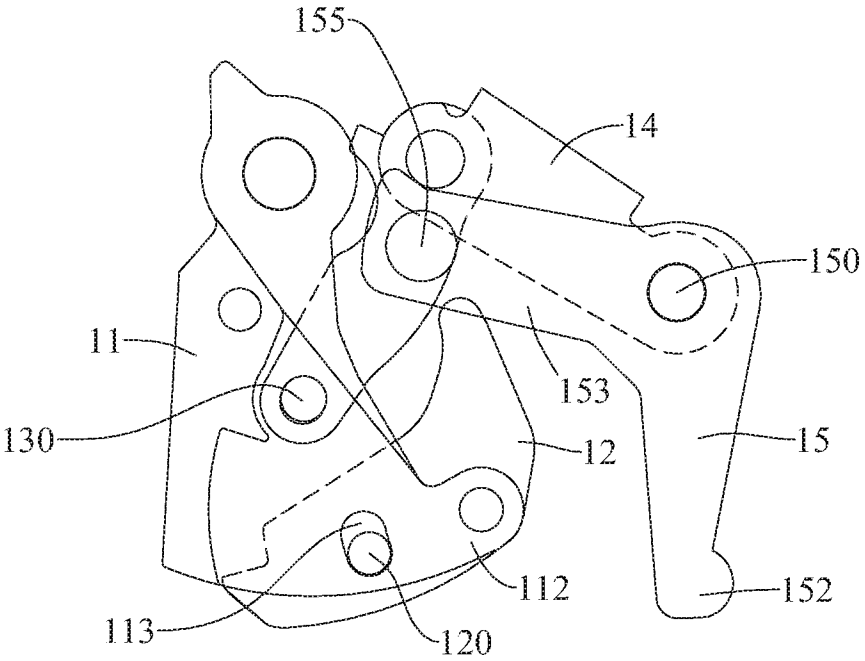
FIG. 7 is a schematic view of a portion of the anti-theft door lock assembly in a motion state in accordance with this disclosure.

Referring to FIG. 3 and FIG. 6, one end of the pushed member 13 is pivoted to another end of the lock tongue 11 via a pushed pin 130. The pushed member 13 is located between the push member 12 and the lock tongue 11. A pivotal pin 131 penetrates through another end of the pushed member 13, a torsion spring (not shown in the figure) and on end of the connection link 14, so that the pushed member 13 can be connected with the push member 12. One end of the torsion spring contacts against the pushed member 13, while another end of the torsion spring contacts against the connection link 14.

Referring now further to FIG. 3 and FIG. 6, a push-down pivotal pin 150 penetrates through the main mounting frame structure 100, a rocker-arm torsion spring 151, an action member 154 and the depression rocker arm 15, so that the depression rocker arm 15 can be pivotally mounted to the main mounting frame structure 100. One end of the depression rocker arm 15 is served as a depression end 152, while another end of the depression rocker arm 15 is served as a push end 153. The push end 153, contacting the pivotal pin 131, has a push lever 155 extending from the main structural aperture 101 to outsides of the main mounting frame structure 100. The action member 154 has an action end 156 to push the depression end 152. One end of the rocker-arm torsion spring 151 is contacted against the action member 154, while another end of the rocker-arm torsion spring 151 is contacted against the push-down pivotal pin 150.

Figure 2:
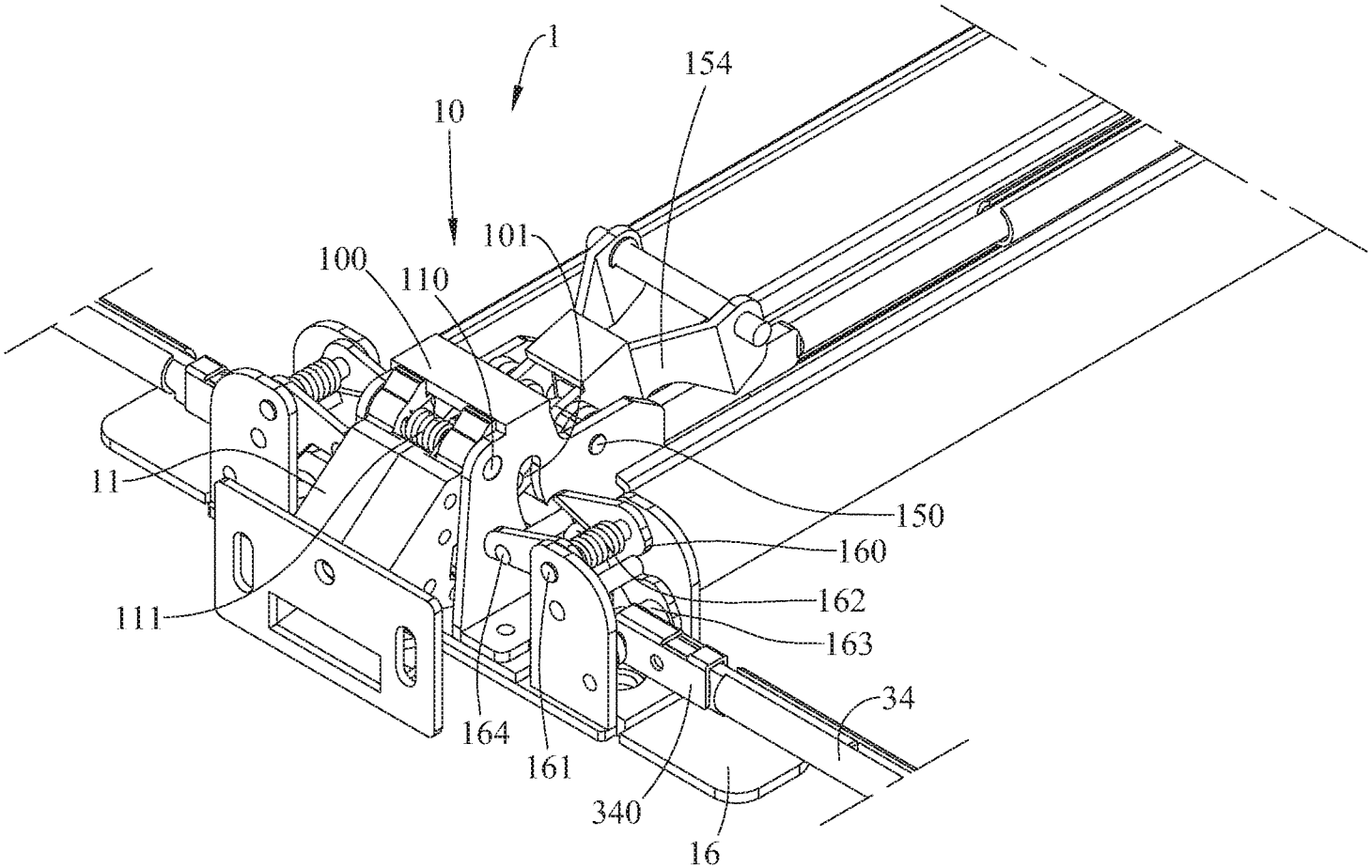
FIG. 2 is a schematic perspective view of the main locking unit in accordance with this disclosure.

In this disclosure, at least one auxiliary lock set 16 is included, and is disposed lateral to the main lock set 10. Referring now to FIG. 2, in this embodiment, two auxiliary lock sets 16 are included and disposed individually to two opposing sides of the main lock set 10. Each of the two auxiliary lock sets 16 has an auxiliary rocker arm 160. An auxiliary pivotal pin 161 is introduced to penetrate through the auxiliary lock set 16, an auxiliary torsion spring 162 and the auxiliary rocker arm 160, so that the auxiliary rocker arm 160 can be connected with the auxiliary lock set 16. One end of the auxiliary rocker arm 160 is served as an auxiliary-lock push end 163, while another end of the auxiliary rocker arm 160 is served as an auxiliary contact end 164. The auxiliary contact end 164 is depressed upon the push lever 155.

Figure 4:
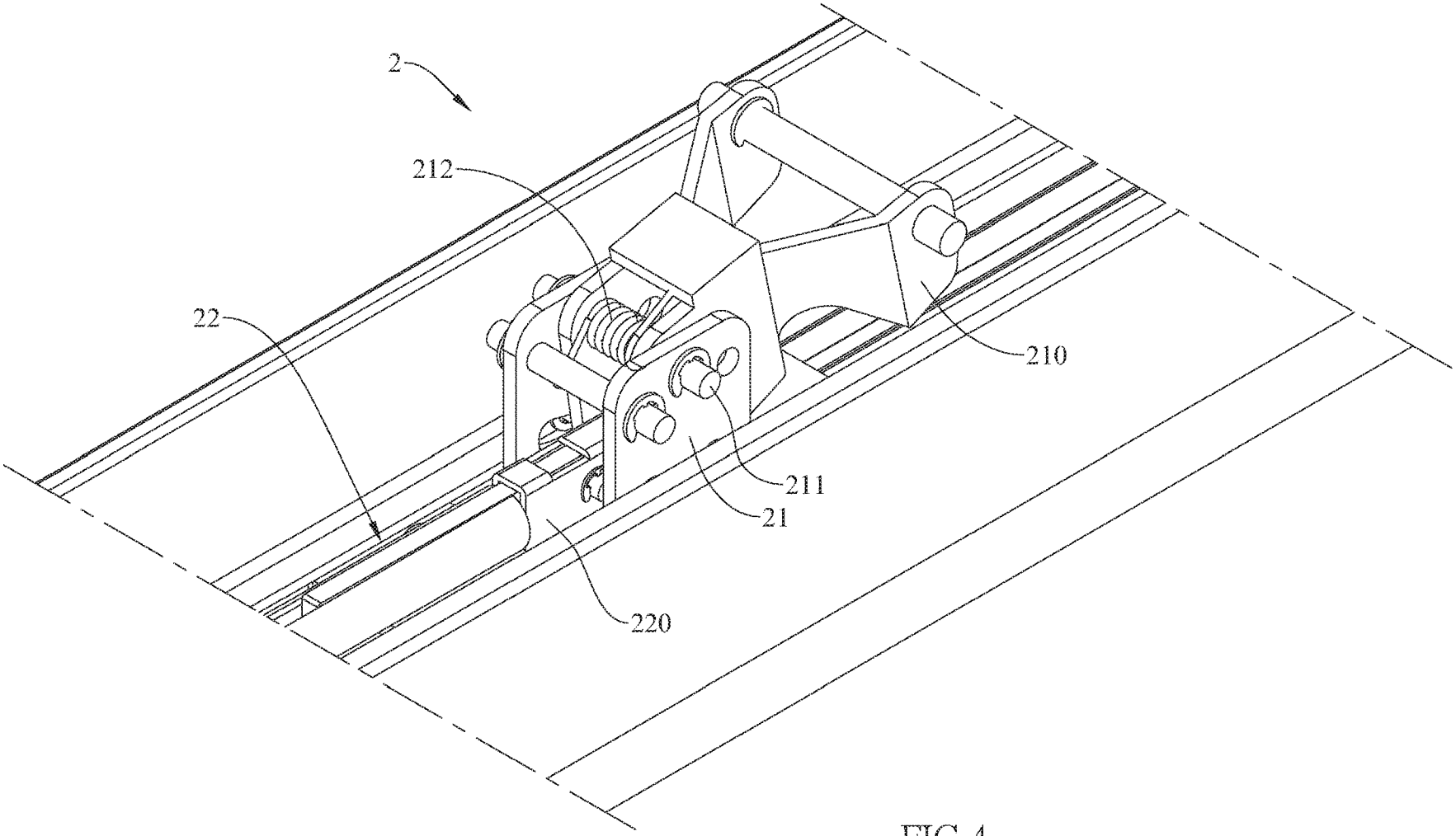
FIG. 4 is a schematic perspective view of the depressing unit in accordance with this disclosure.

Referring to FIG. 4 and FIG. 1, the depressing unit 2 has a push-down cover 20, a depression-mounting frame 21 and an extension linkage 22. The depression-mounting frame 21 has a press-down rocker arm 210. A push-down pivotal pin 211 is introduced to penetrate through the depression-mounting frame 21, a push-down torsion spring 212 and the press-down rocker arm 210, so that the press-down rocker arm 210 can be pivotally mounted to the depression-mounting frame 21. One end of the push-down torsion spring 212 is contacted against the press-down rocker arm 210, while another end of the push-down torsion spring 212 is contacted against the depression-mounting frame 21.

The push-down cover 20, disposed over the depression-mounting frame 21, has a surface (the inner surface) to directly contact the press-down rocker arm 210. The extension linkage 22 has a main extension bar, an auxiliary extension bar and two hook elements 220. One of the two hook elements 220 is coupled with the main extension bar, the auxiliary extension bar is coupled with the main extension bar, and another hook element 220 is coupled with the auxiliary extension bar. The aforesaid coupling means between any two of the foregoing extension bars and hook elements can be a pin-hole means or a screw-tight means. For example, the hook element 220 couples the main extension bar or the auxiliary extension bar, respectively, via the pin-hole means, and the auxiliary extension bar is tightly screwed to the main extension bar. In particular, the coupling between the auxiliary extension bar and the main extension bar can be adjustable so as to vary a total length of the extension linkage 22. Thereupon, in the case that the extension linkage 22 is to hook two objects but provides insufficient lengths, the two hook elements220 can vary positions at the extension linkage 22, so that the extension linkage 22 can apply the two hook elements 220 to hook the corresponding objects.

Figure 8:
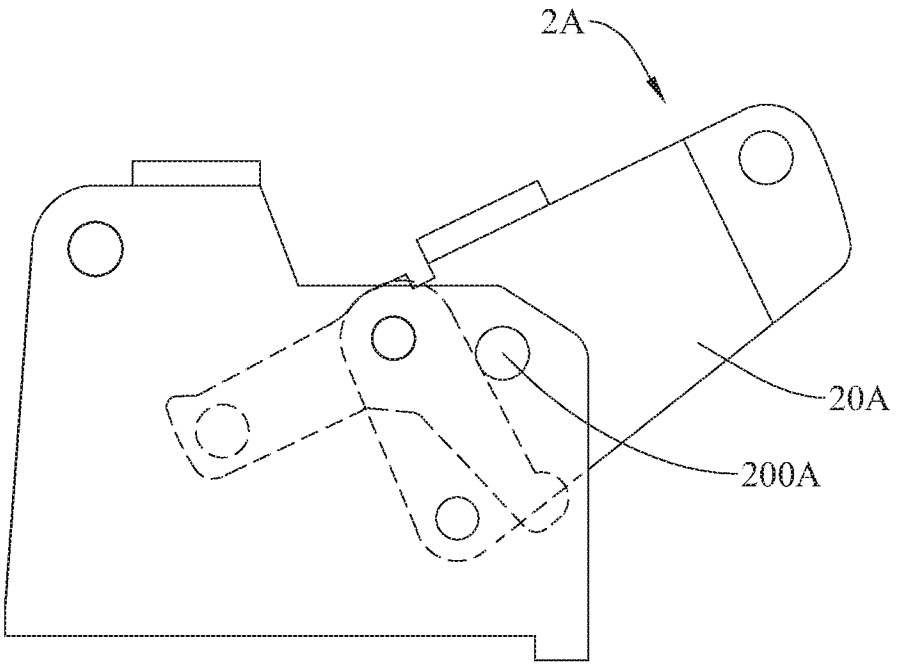
FIG. 8 is a schematic view of another embodiment of the depressing unit in accordance with this disclosure.

In another embodiment, referring to FIG. 8, the depressing unit 2A can be embodied as a push-down handle 20A. The push-down handle 20A has a depression bar 200A for depressing the depression end 152 of the depression rocker arm 15. Motion of the push-down handle 200A is similar to that of the aforesaid extension linkage 22, and motions of the depression-mounting frame 21 and the push-down cover 20 are similar to those of the aforesaid push end 153 and the depression end 152. When the push-down handle 20A is pressed down, the depression bar 200A would further push down the depression end 152, and the push lever 155 of the push end 153 would thus pull up the pushed pin 130.

Figure 5:
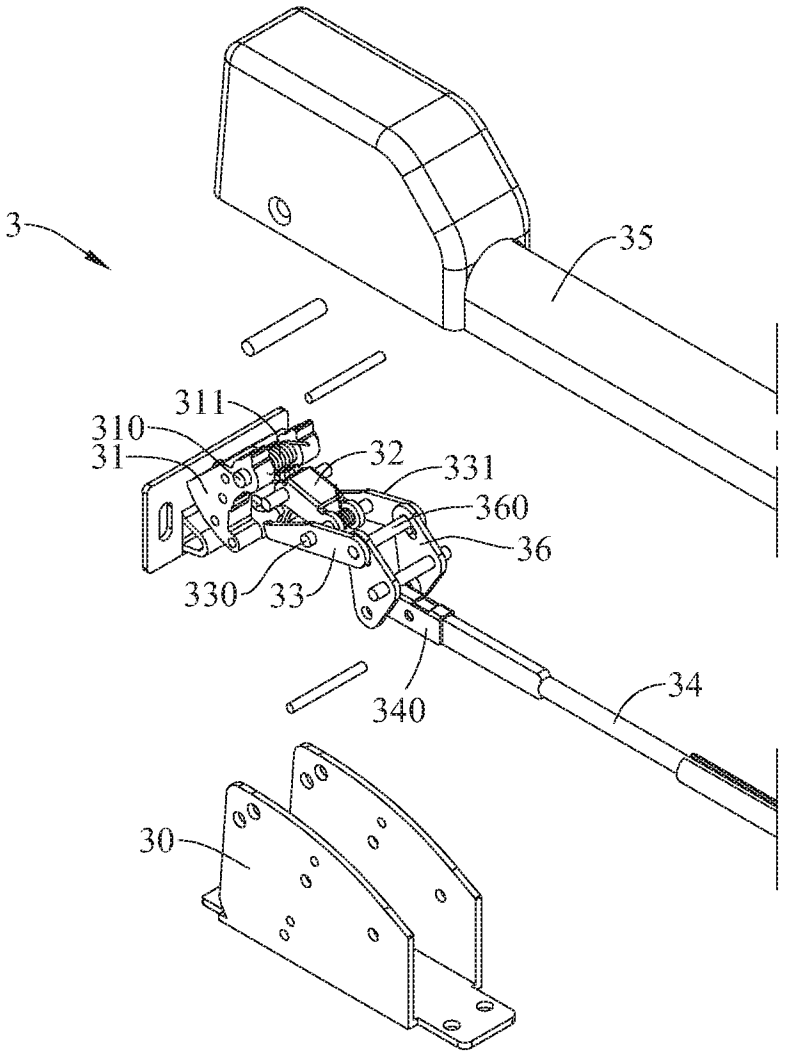
FIG. 5 is a schematic large exploded view of the auxiliary locking unit in accordance with this disclosure.

Referring to FIG. 5, the auxiliary locking unit 3 has an auxiliary lock-mounting frame 30, an auxiliary lock tongue 31, an auxiliary-lock pull member 32, a first auxiliary-lock connection link 33, a second auxiliary-lock connection link 36, an auxiliary-lock extension linkage 34 and an auxiliary-lock cover 35. An auxiliary pivotal pin 310 is introduced to penetrate through the auxiliary lock-mounting frame 30, the auxiliary lock tongue 31 and an auxiliary-lock torsion spring 311, so that the auxiliary lock tongue 31 can be mounted pivotally to the auxiliary lock-mounting frame 30. One end of the auxiliary-lock torsion spring 311 contacts against the auxiliary lock tongue 31, while another end of the auxiliary-lock torsion spring 311 contacts against the auxiliary lock-mounting frame 30. Thereupon, the auxiliary-lock torsion spring 311 can provide the necessary spring force for protruding the auxiliary lock tongue 31 out of the auxiliary lock-mounting frame 30 from a state of the auxiliary lock tongue 31 retrieved into the auxiliary lock-mounting frame 30.

One end of the auxiliary lock tongue 31 protrudes out of the auxiliary lock-mounting frame 30, and a bottom portion of the auxiliary lock tongue 31 is furnished with an auxiliary-lock push member (not shown in the figure). The auxiliary-lock push member can be retrieved into the auxiliary lock tongue 31. The auxiliary-lock pull member 32 is connected with another end of the auxiliary lock tongue 31.

An auxiliary-lock pivotal pin 330 is introduced to penetrate through one end of the first auxiliary-lock connection link 33, an auxiliary-lock connection spring 331 and another end of the auxiliary-lock pull member 32, so that the first auxiliary-lock connection link 33 can be pivotally connected with the auxiliary-lock pull member 32.

One end of the auxiliary-lock connection spring 331 contacts against the first auxiliary-lock connection link 33, while another end of the auxiliary-lock connection spring 331 contacts against the auxiliary-lock pull member 32. A connection pin 360 is used to penetrate through another end of the first auxiliary-lock connection link 33 and the second auxiliary-lock connection link 36, so that the first auxiliary-lock connection link 33 can be pivotally connected with the second auxiliary-lock connection link 36.

Referring to FIG. 5 and FIG. 2, the auxiliary-lock extension linkage 34 has a main auxiliary-lock extension bar, a second auxiliary-lock extension bar and two auxiliary-lock hook elements 340. One of the two auxiliary-lock hook elements 340 is coupled with the main auxiliary-lock extension bar, the second auxiliary-lock extension bar is coupled with the main auxiliary-lock extension bar, and another auxiliary-lock hook element 340 is coupled with the second auxiliary-lock extension bar. The aforesaid coupling means between any two of the foregoing auxiliary-lock extension bars and auxiliary-lock hook elements can be a pin-hole means or a screw-tight means. For example, the auxiliary-lock hook element 340 couples the main auxiliary-lock extension bar or the second auxiliary-lock extension bar, respectively, via the pin-hole means, and the second auxiliary-lock extension bar is tightly screwed to the main auxiliary-lock extension bar. In particular, one of the two auxiliary-lock hook elements 340 is hooked to the second auxiliary-lock connection link 36, while another auxiliary-lock hook element 340 is hooked to the auxiliary-lock push end 163.

Since the screw-tight coupling between the second auxiliary-lock extension bar and the main auxiliary-lock extension bar is adjustable to vary a total length of the auxiliary-lock extension linkage 34. Thereupon, in the case that the auxiliary-lock extension linkage 34 is to hook two objects but provides insufficient lengths, the two auxiliary-lock hook elements 340 can vary positions at the auxiliary-lock extension linkage 34, so that the auxiliary-lock extension linkage 34 can apply the two auxiliary-lock hook elements 340 to hook the corresponding objects.

Referring to FIG. 6, FIG. 7, FIG. 1, FIG. 3 and FIG. 4, if the push-down cover 20 of the depressing unit 2 is pressed down, the press-down rocker arm 210 is thus depressed down by the push-down cover 20 so that a push-down torsion spring 213 is compressed. Simultaneously, the press-down rocker arm 210 pulls the extension linkage 22, and then the extension linkage 22 is further to pull the action member 154.

The action end 156 of the action member 154 depresses the depression end 152 of the depression rocker arm 15, and then the push end 153 is rotated to push the pivotal pin 131, so that rotation between the pushed member 13 and the connection link 14 is made. Thereupon, the lock tongue 11 is retrieved into the main mounting frame structure 10. In this state, the lock tongue 11 compresses the lock-tongue torsion spring 111, the pushed member 13 is forced by the compressed torsion spring 111, and the action member 154 compresses the rocker-arm torsion spring 151.

Referring to FIG. 2, in the case that the lock tongue 11 is retrieved into the main mounting frame structure 10, the push member 12 would be retrieved into the lock tongue 11. The push spring 121 is compressed by the push member 12. As the push lever 155 displaces along the main structural aperture 101, the auxiliary contact end 164 is pushed, the auxiliary rocker arm 160 compresses the auxiliary torsion spring 162, the auxiliary-lock push end 163 pulls the auxiliary-lock extension linkage 34, the pulled auxiliary-lock extension linkage 34 moves the first auxiliary-lock connection link 33 so as to move the auxiliary-lock pull member 32 as well, thus the auxiliary lock tongue 31 is retrieved into the auxiliary lock-mounting frame 30, and the auxiliary-lock push member is retrieved into the auxiliary lock tongue 31. In this state, the first auxiliary-lock connection link 33 is to compress the auxiliary-lock connection spring 331.

Since the lock tongue 11 is retrieved into the main lock set 10, and the auxiliary lock tongue 31 is retrieved into the auxiliary lock-mounting frame 30, thus the safety door furnished with the aforesaid door lock assembly can be shifted from a locking state to an unlock state, so that the safety door can be opened.

After the safety door is opened, and the push-down cover 20 is released, then the push-down torsion spring 213 would drive the press-down rocker arm 210 back to its initial position. In other words, the push-down cover 20 is sent back to a depression-free position. The lock-tongue torsion spring 111 of this disclosure is to provide a spring force for driving the lock tongue 11 to a state of protruding out of the main mounting frame structure 100; i.e., the state prior to the lock tongue 11 being retrieved into the main mounting frame structure 100.

The push spring is to provide a spring force for driving the push member 12 to protrude out of the lock tongue 11, and another torsion spring is to provide a spring force to drive the pushed member 13 back to its initial position.

The rocker-arm torsion spring 151 is to provide a spring force to drive the action member 154 and the depression rocker arm 15 back to the corresponding initial positions. The auxiliary torsion spring 162 is to provide a spring force for driving the auxiliary rocker arm 160 back to its initial position. The auxiliary-lock connection spring 331 is to provide a spring force for driving the first auxiliary-lock connection link 33 back to its initial position. Also, the auxiliary-lock torsion spring 331 is to provide a spring force for driving the auxiliary lock tongue 31 to protrude out of the auxiliary lock-mounting frame 30. Namely, the auxiliary-lock push member is sent back to its initial position, and thus protrudes out of the auxiliary lock tongue 31.

Since the lock tongue 11 is controlled by the pushed member 13 to protrude or retrieve with respect to the main lock set 10, thus, when the safety door is in the locking state, the lock tongue 11 restrained by the pushed member 13 is unable to be retrieved back to the main lock set 10, even that the lock tongue 11 is forced by any arbitrary foreign forcing. Thereupon, the safety door would not be easy to be pried open, and thus possible illegal invasion by unexpected persons via the safety door would be inhibited.

With respect to the above description then, it is to be realized that the optimum dimensional relationships for the parts of the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present disclosure.

What is claimed is:

1. An anti-theft door lock assembly, comprising:

a main locking unit, further including:

a main lock set;

a lock tongue, disposed inside the main lock set, having one end thereof to protrude out of the main lock set;

a pushed member, disposed inside the main lock set, connected with another end of the lock tongue;

a connection link, disposed inside the main lock set, connected with the pushed member;

an action member, disposed at one end of the main lock set;

a depression rocker arm, furnished to the main lock set, connected with the connection link;

at least one auxiliary lock set, disposed respectively to at least one side of the main lock set, each of the at least one auxiliary lock set having an auxiliary rocker arm moving with the lock tongue; and at least one auxiliary locking unit, each of the at least one auxiliary locking unit having an auxiliary lock-mounting frame, an auxiliary lock tongue, an auxiliary-lock pull member, an auxiliary-lock connection link and an auxiliary-lock extension linkage, the auxiliary lock tongue being disposed in the auxiliary lock-mounting frame but protruding a portion thereof out of the auxiliary lock-mounting frame, the auxiliary-lock pull member being disposed in the auxiliary lock-mounting frame and connected with the auxiliary lock tongue, the auxiliary-lock connection link being disposed in the auxiliary lock-mounting frame and connected with the auxiliary-lock pull member, one end of the auxiliary-lock extension linkage being connected with the auxiliary-lock connection link while another end of the auxiliary-lock extension linkage is connected with the auxiliary rocker arm;

wherein the main lock set has a main mounting frame structure, each of two opposing sides of the main mounting frame structure has a main structural aperture, a lock-tongue installation pin penetrates through the main mounting frame structure, the lock tongue and a lock-tongue torsion spring so as to mount pivotally the lock tongue to the main mounting frame structure, the lock tongue has an accommodation space located at a bottom portion thereof and a guide hole communicated spatially with the accommodation space, a push member is disposed in the accommodation space but protruding one end thereof out of the accommodation space, a push rod penetrates through the guide hole, a push spring and the push member so as to mount pivotally the push member to the lock tongue, and the depression rocker arm has a pivotal pin extending out of the main mounting frame structure from the main structural aperture;

wherein the pushed member is located between the push member and the lock tongue, another pivotal pin penetrates through another end of the pushed member, a torsion spring and one end of the connection link so as to connect the pushed member and the connection link.

2. The anti-theft door lock assembly of claim 1, further including a depressing unit and a push-down cover, the depressing unit having a depression-mounting frame and an extension linkage, the depression-mounting frame being furnished with a push-down rocker arm, one end of the extension linkage being connected with the push-down rocker arm while another end of the extension linkage is connected with the press-down rocker arm, the push-down cover being disposed above the push-down rocker arm.

3. The anti-theft door lock assembly of claim 1, further including a depressing unit having a depression bar, the depression bar being moved with the depression rocker arm.

4. The anti-theft door lock assembly of claim 1, wherein the depression rocker arm is pivotally mounted to the main mounting frame structure via a pivotal pin, the pivotal pin penetrates through the action member, a rocker-arm torsion spring and the depression rocker arm, one end of the depression rocker arm serves as a depression end while another end of the depression rocker arm serves as a push end, and the push end contacts against the pivotal pin.

5. The anti-theft door lock assembly of claim 1, wherein a push-down pivotal pin penetrates through a depression-mounting frame, a push-down torsion spring and a push-down rocker arm, the extension linkage has a main extension bar, an auxiliary extension bar and two hook elements, one of the two hook elements is connected with the main extension bar, the auxiliary extension bar is connected with the main extension bar, another one of the two hook elements is connected with the auxiliary extension bar, the one of the two hook elements is hooked with the push-down rocker arm, and the another one of the two hook elements is hooked with the depression end of the depression rocker arm.

6. The anti-theft door lock assembly of claim 5, wherein the auxiliary-lock pull member and the auxiliary-lock connection link are connected via an auxiliary-lock pivotal pin, and the auxiliary-lock pivotal pin penetrates through one end of the auxiliary-lock connection link, an auxiliary-lock connection spring and another end of the auxiliary-lock pull member.

7. The anti-theft door lock assembly of claim 5, wherein one end of the auxiliary rocker arm serves as an auxiliary-lock push end, the auxiliary-lock extension linkage has a main auxiliary-lock extension bar, a second auxiliary-lock extension bar and two auxiliary-lock hook elements, one of the two auxiliary-lock hook elements is connected with the main auxiliary-lock extension bar, the second auxiliary-lock extension bar is connected with the main auxiliary-lock extension bar, another one of the two auxiliary-lock hook elements is connected with the second auxiliary-lock extension bar, the one of the two auxiliary-lock hook elements is hooked with the auxiliary-lock connection link, the another one of the two auxiliary-lock hook elements is hooked with the auxiliary-lock push end, and an auxiliary-lock cover is to cover the auxiliary-lock extension linkage.

* * * * *